US007585084B2

(12) United States Patent
Kinnune et al.

(10) Patent No.: US 7,585,084 B2
(45) Date of Patent: Sep. 8, 2009

(54) CEILING FIXTURE MOUNT-FACILITATING ASSEMBLY

(75) Inventors: Brian L. Kinnune, Racine, WI (US); Kurt S. Wilcox, Libertyville, IL (US)

(73) Assignee: Ruud Lighting, Inc., Racine, WI (US)

( * ) Notice: Subject to any disclaimer, the term of this patent is extended or adjusted under 35 U.S.C. 154(b) by 126 days.

(21) Appl. No.: 11/708,777

(22) Filed: Feb. 21, 2007

(65) Prior Publication Data

US 2008/0198611 A1 Aug. 21, 2008

(51) Int. Cl.
*F21S 8/00* (2006.01)

(52) U.S. Cl. ..... 362/147; 362/285

(58) Field of Classification Search ..... 362/145, 362/147, 148, 150, 285, 364, 365, 368, 370, 362/371, 374, 375, 396, 404, 406, 418, 430, 362/455, 647; 248/200, 300, 188.6
See application file for complete search history.

(56) References Cited

U.S. PATENT DOCUMENTS 4,199,803 A 4/1980 Hunt, III
4,222,093 A 9/1980 Garcia et al.
4,368,506 A 1/1983 Rapp
4,403,278 A 9/1983 Flood
4,837,669 A 6/1989 Tharp et al.
5,345,369 A * 9/1994 Ruud et al. ..... 362/145
5,465,199 A 11/1995 Bray et al.
6,290,375 B1 * 9/2001 LeVasseur ..... 362/368
2003/0116685 A1 6/2003 Jensen

FOREIGN PATENT DOCUMENTS

JP 2005232771 A * 9/2005

* cited by examiner

*Primary Examiner*—Hargobind S Sawhney
(74) *Attorney, Agent, or Firm*—Jansson Shupe & Munger Ltd.

(57) ABSTRACT

A ceiling fixture mounting assembly including a box for affixing to a ceiling and containing electrical wiring, the box having opposite vertical sidewalls each with first and second laterally spaced threaded holes receiving corresponding first and second fasteners, and two vertical mounting plates each projecting upwardly from the fixture to terminate in an upper edge and positioned to overlie one of the sidewalls and each having first and second ways receiving the first and second fasteners, respectively, the first way configured for supporting the fixture at an angle to the box for connecting the wires, wherein the improvement comprises each fastener having a head and a threaded portion and the first and second ways having first and second mounting slots, respectively, each having a lower closed end and an upper open end and sized smaller than the head, the plate having a recess at the closed end configured to receive the head such that it is in vertical alignment with the open end, thereby holding the plate in position against the box.

24 Claims, 7 Drawing Sheets

CEILING FIXTURE MOUNT-FACILITATING ASSEMBLY

FIELD OF THE INVENTION

The present invention related to light-fixture mounting, in particularly to an assembly facilitating fixture mounting to a ceiling.

BACKGROUND OF THE INVENTION

Ceiling mounted lighting fixtures are well known in the art and are used in a variety of applications, including for use in commercial, industrial and other institutional settings. Such lighting fixtures present certain challenges in installation and servicing of the fixture. Because the light fixture is ceiling mounted, typically an installer must stand on a ladder to access the fixture. Fixtures of this type tend to be large and heavy which can make for difficulty in mounting overhead. Further, during installation or when the fixture needs servicing, the fixture may be left in a vulnerable and unstable position. For example, U.S. Pat. No. 4,368,506 to Rapp discloses an Apparatus for Mounting a Luminaire to a Ceiling. Rapp states it is an object of the invention to provide an apparatus for mounting the luminaire to the ceiling which requires only one person to position the luminaire and make the electrical connection and secure the luminaire to the ceiling. However, the Rapp device is relatively complex due to the rigid nature of the bracket on which the fixture is mounted. Rapp requires a series of angular movements to secure the ceiling fixture to the bracket which further complicates the already challenging process of installing ceiling mounted fixtures.

Although such conventional mounting assemblies provide a satisfactory mounting once the fixture is installed and in the final mounting position, the installation process can be difficult. In view of the foregoing disadvantages seen in known ceiling mounted fixture assemblies, it would be desirable to provide a mounting assembly that simplifies the steps involved in installation and maintenance. Further, there is a need for a mounting assembly providing more stability to the fixture during installation and servicing.

OBJECTS OF THE INVENTION

It is an object of the invention to provide an improved ceiling fixture mounting assembly overcoming some of the problems and shortcomings of the prior art, including those referred to above.

Another object of the invention is to provide a ceiling fixture mounting assembly that is readily adaptable for easy installation and servicing of a ceiling fixture.

Another object of the invention is to provide a ceiling fixture mounting assembly providing excellent protection and stability of a ceiling fixture during installation and when in the servicing position.

Another object of the invention is to provide a ceiling fixture mounting assembly with mounting plates configured for easy and convenient installation and performance of routine maintenance of a ceiling fixture.

Still another object of the invention is to provide a ceiling fixture mounting assembly adapted to facilitate precise location and positioning of the fixture in its final mounted position.

Yet another object of the invention is to provide a ceiling fixture mounting assembly having improved protection of the ceiling fixture from dirt, debris and other particulate matter that may interfere with proper functioning of the fixture.

Another object of the invention is to provide a ceiling fixture mounting assembly that is adapted to allow electrical connections to be made prior to mounting the fixture.

Still another object of the invention is to provide a ceiling fixture mounting assembly that facilitates full support of a fixture when the fixture is in an open position.

How these and other objects are accomplished will become apparent from the following descriptions and the drawings.

SUMMARY OF THE INVENTION

The present invention is an improvement in ceiling fixture mounting assemblies. The inventive ceiling fixture mounting assembly includes a box for affixing to a ceiling and containing the necessary electrical wiring. Further, the box includes opposite vertical sidewalls, each sidewall having first and second laterally spaced threaded holes. The first and second laterally spaced threaded holes receive corresponding first and second fasteners. In the improvement, the fasteners have a head and a threaded portion. The box also includes two vertical mounting plates, each plate projecting upwardly from the fixture and terminating in an upper edge. The plates are positioned to overlie one of the sidewalls and each plate includes first and second ways. The ways receive first and second fasteners. The first way is configured to support the fixture at an angle to the box for connecting the wires. Further, in accordance with the improvement, the first and second ways have first and second mounting slots. The mounting slots each include a lower closed end and an upper open end that is sized smaller than the fastener head. The vertical mounting plates have a recess at the closed end that is configured to receive the fastener head such that it is in vertical alignment with the open end, thereby holding the plate in position against the box.

In preferred embodiments, the recess is tapered. The fastener head also includes a taper toward the threaded portion of the fastener mating with the tapered recess.

In other embodiments, the vertical mounting plates are part of a one-piece bracket. The one-piece bracket may further include a horizontal water/air-tight sealing closure positioned between the box and the fixture for sealingly engaging the box when the fixture is in its final mounted position.

In some preferred embodiments, the first way of the vertical mounting plates includes an entry slot and a hanging slot. The entry slot extends from the upper edge downwardly and laterally to join the upper open end of the first mounting slot. The hanging slot is laterally offset from the entry slot and extends from the upper closed end to join the open end of the first mounting slot. The hanging slot loosely receives the threaded portion of first fastener whereby the plates and the fixture are suspended by the first fasteners at an angle to facilitate wiring and service of the fixture.

Further, in highly preferred embodiments, the hanging slot is bounded by a downwardly extending retainer portion of the plates. The retainer portion is positioned between the entry slot and the hanging slot. This arrangement restricts the fixture from lateral movement in its hanging position which could otherwise cause the fixture to fall.

In certain embodiments, the upper edge of the plates includes a folded-over portion adjacent to and above the closed end of the hanging slot. The folded-over portion strengthens the plates in that area.

Where the plates are part of a one-piece bracket, the open ends of the mounting slots are preferably in substantial lateral alignment such that, after wiring and rotation of the hanging fixture to a horizontal orientation, movement of the fixture into the final mounted position is with the fixture being in a substantially horizontal orientation. Further, in such an embodiment, the upper edge of the plates includes first and second edge-portions that are positioned above the first and second ways. The second-edge portion is lower than the first-edge portion and facilitates reception of the second fastener into the second mounting slot.

It is preferable that the mounting slots be substantially vertical. The hanging slot and the first mounting slot is preferably substantially aligned to facilitate assumption of the angled hanging position upon loosening of the fasteners.

DETAILED DESCRIPTION OF PREFERRED EMBODIMENTS

FIGS. 1-7 illustrate the preferred embodiments of a ceiling fixture mounting assembly in accordance with this invention.

Figure 1:
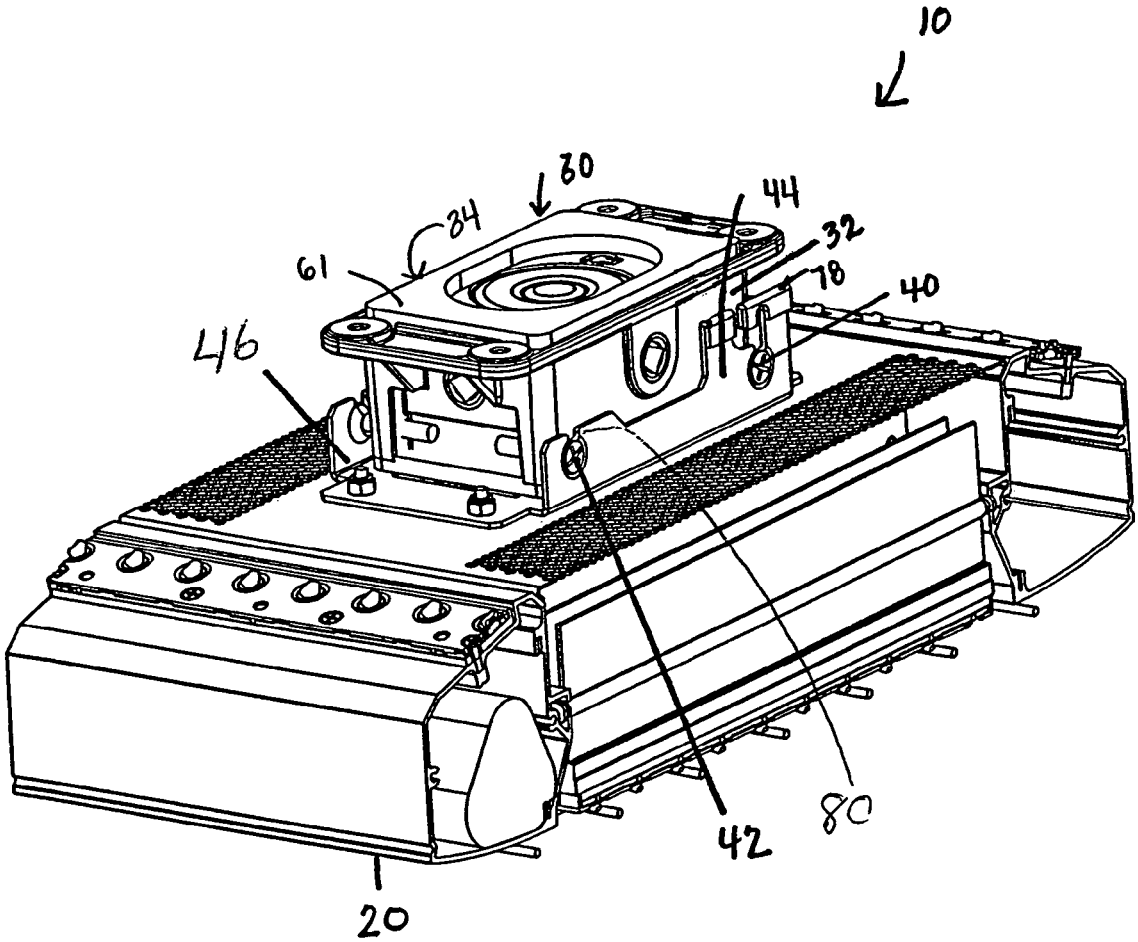
FIG. 1 is a perspective view of a preferred ceiling fixture mount-facilitating assembly in accordance with this invention showing the assembly in the final-mounted position.
Figure 2:
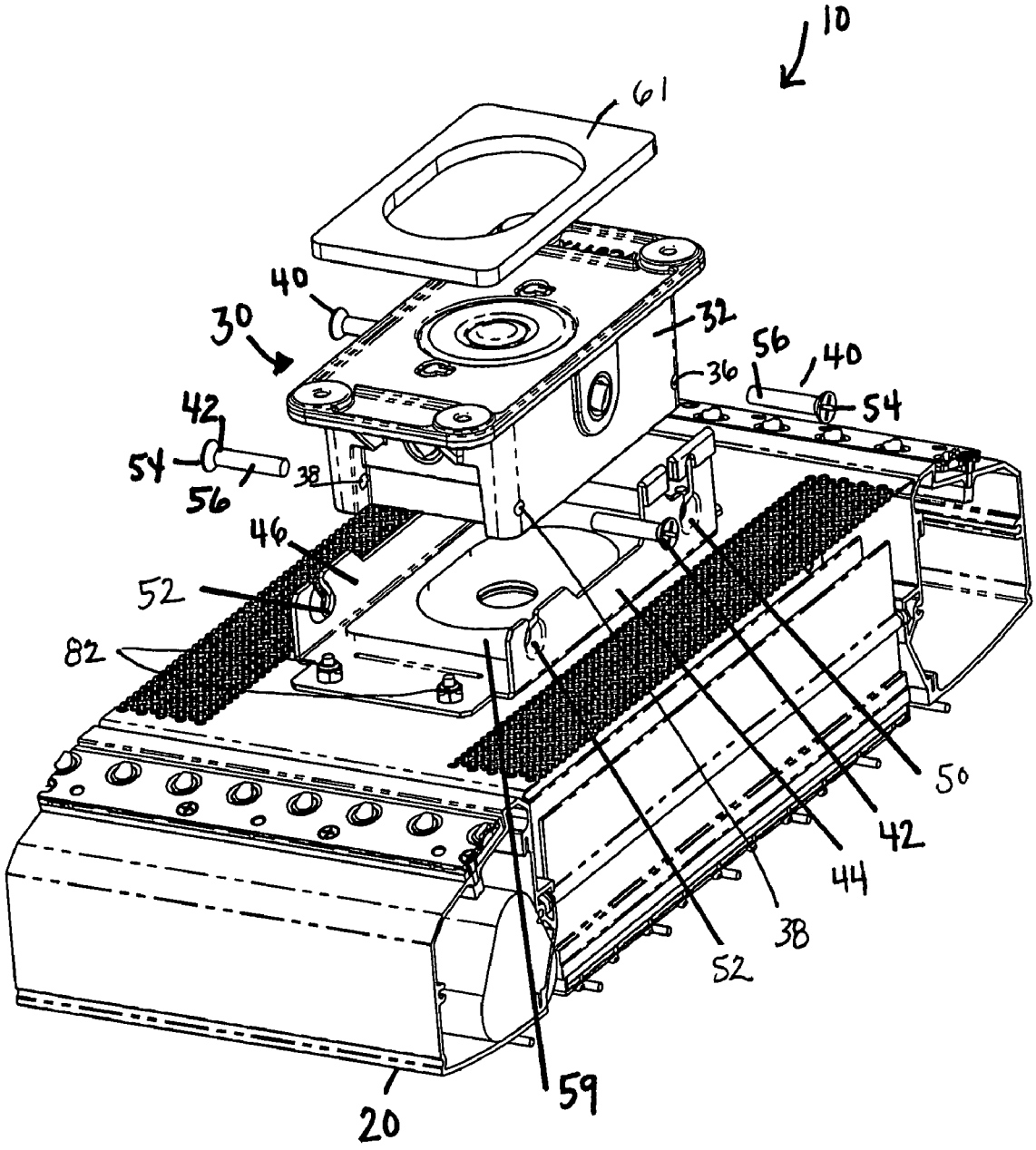
FIG. 2 is a an exploded perspective view of the ceiling fixture mount-facilitating assembly of FIG. 1.
Figure 3:
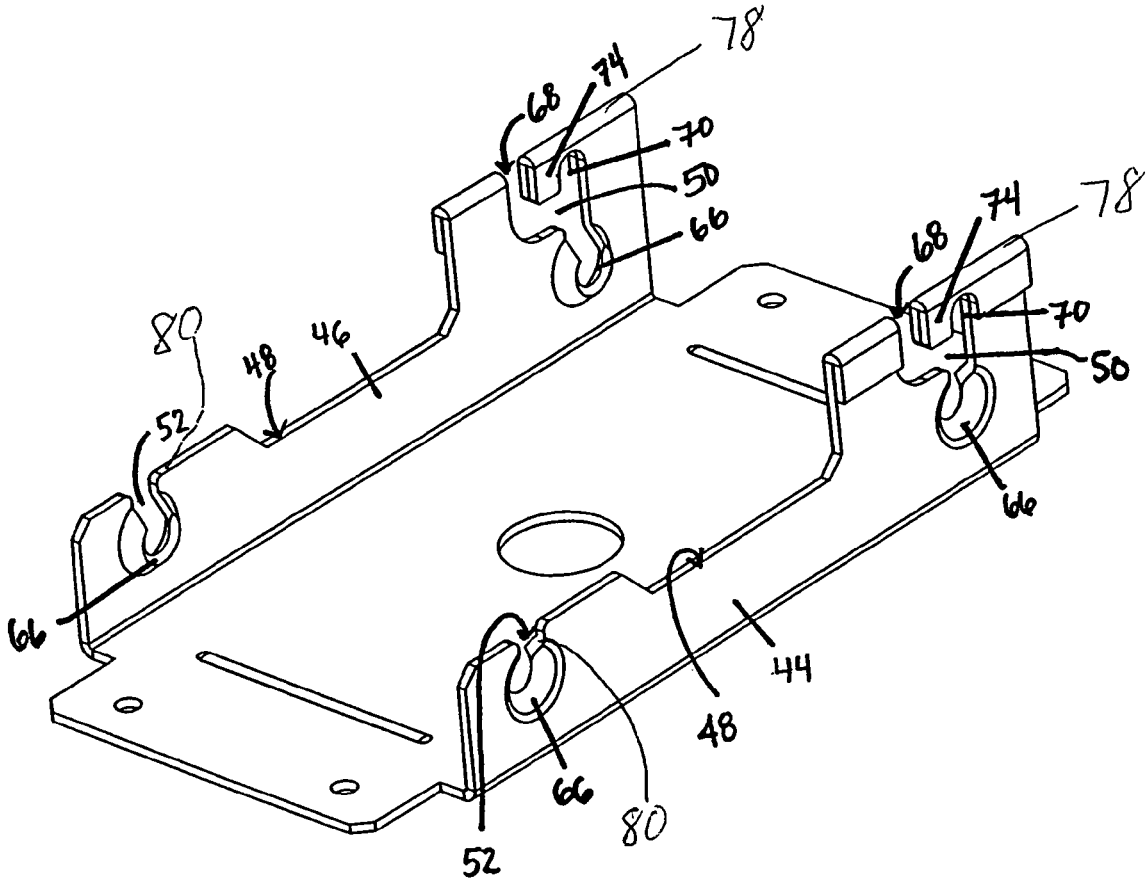
FIG. 3 is a perspective view of the two vertical mounting plates in accordance with the invention.
Figure 5:
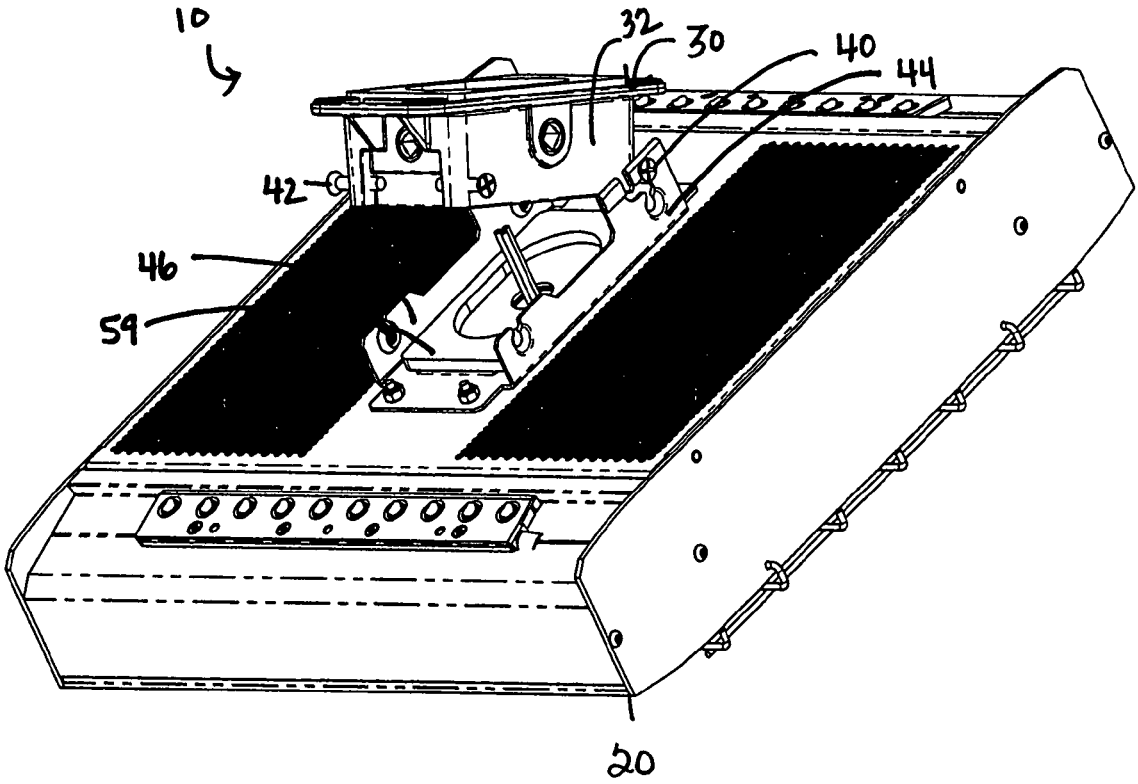
FIG. 5 is yet another perspective view of a preferred ceiling fixture mount-facilitating assembly showing the assembly in open mounting position.

Referring first to FIG. 1, ceiling fixture mounting assembly 10 includes a box 30 for affixing to a ceiling and contains electrical wiring. Box 30 includes opposite vertical sidewalls, 32 and 34 respectively, each sidewall having first and second laterally spaced threaded holes, 36 and 38 respectively. First and second laterally spaced threaded holes, 36 and 38, receive corresponding first and second fasteners, 40 and 42, respectively, as shown in FIG. 5. Referring to FIGS. 2 and 3, fasteners 40 and 42 preferably have a head 54 and a threaded portion 56 for engagement with first and second laterally spaced threaded holes, 36 and 38.

Referring still to FIGS. 2 and 3, box 30 further includes two vertical mounting plates, 44 and 46 respectively, each projecting upwardly from the fixture 20 to terminate in an upper edge 48 and positioned to overlie one of sidewalls 32 and 34. Vertical mounting plates 44 and 46 each include first and second ways, 50 and 52 respectively, that receive first and second fasteners, 40 and 42, respectively. First way 50 is configured to support fixture 20 at an angle to box 30 for connecting the wires, as illustrated in FIG. 5.

Figure 4:
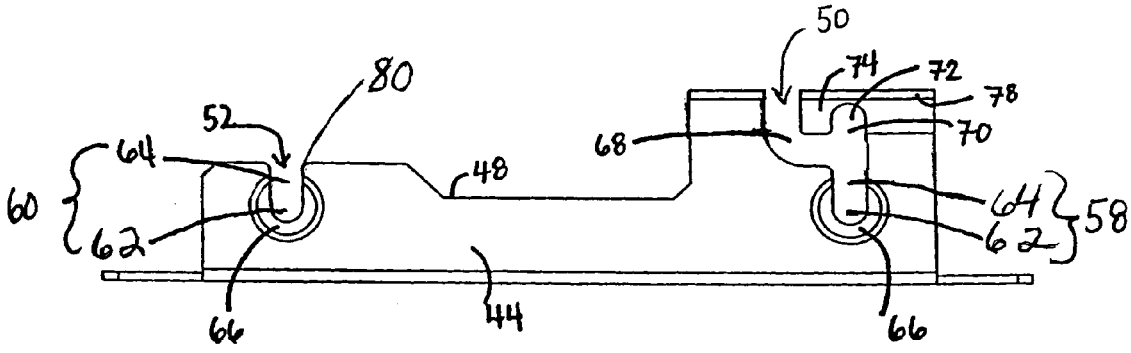
FIG. 4 is a side perspective view of one of the vertical mounting plates of FIG. 3.

As best seen in FIG. 4, first and second ways, 50 and 52, have first and second mounting slots, 58 and 60 respectively. Mounting slots 58 and 60 each include a lower closed end 62 and an upper open end 64 that is sized smaller than head 54. Vertical mounting plates 44 and 46 have a recess 66 at closed end 62 that is configured to receive head 54 such that it is in vertical alignment with open end 64, thereby holding the plate in position against box 30. Recess 66 is preferably tapered, as shown in FIG. 3. Working together with tapered recess 66 is preferably a tapered fastener head 54 that includes a taper toward threaded portion 56 of the fastener mating with tapered recess 66.

Referring now to FIGS. 3 and 4, first way 50 of plates 44 and 46 further includes an entry slot 68 that extends from upper edge 48 downwardly and laterally to join upper open end 64 of first mounting slot 58. Plates 44 and 46 further include a hanging slot 70 that is laterally offset from entry slot 68 and extends from the upper closed end 72 to join the open end 64 of first mounting slot 58. Hanging slot 70 loosely receives threaded portion 56 of first fastener 40 whereby plates 44 and 46 and fixture 20 are suspended by first fasteners 40 at an angle to facilitate wiring and service of fixture 20, as seen in FIG. 5.

Referring again to FIGS. 3 and 4, hanging slot 70 is bounded by a downwardly extending retainer portion 74 of plates 44 and 46 between entry slot 68 and hanging slot 70. This arrangement restricts fixture 20 from lateral movement in its hanging position which could otherwise cause fixture 20 to fall and become damaged. Vertical mounting plates 44 and 46 are preferably part of a one-piece bracket, as shown in FIG. 3. In such embodiments, upper edge 48 of plates 44 and 46 includes a folded-over portion 76 adjacent to and above closed end 72 of hanging slot 70. Folded-over portion 76 strengthens plates 44 and 46 in that area. Further, upper edge 48 of plates 44 and 46 include first and second edge-portions, 78 and 80 respectively, first and second edge portions, 78 and 80 defining first and second ways, 50 and 52, respectively. In such case, second-edge portion 80 is lower than first-edge portion 78 to facilitate reception of second fastener 42 into second mounting slot 60.

FIG. 3 illustrates plates 44 and 46 being part of a one-piece bracket and open ends 64 of mounting slots 58 and 60 are in substantial lateral alignment. In the embodiment, after wiring and rotation of the hanging fixture to a horizontal orientation, movement of fixture 20 into the final mounted position is with fixture 20 in a substantially horizontal orientation, as best seen FIG. 6.

Referring to FIG. 4, mounting slots 58 and 60 may be substantially vertical. Hanging slot 70 and first mounting slot 58 are preferably substantially aligned to facilitate assumption of the angled hanging position upon loosening of fasteners 40 and 42. As seen in FIGS. 2 and 5, the ceiling fixture mount assembly preferably includes a horizontal water/air-tight sealing closure 59 positioned between box 30 and fixture 20 for sealingly engaging box 20 when fixture 30 is in final mounted position. Horizontal water/air-tight sealing closure 59 can be a gasket or any other suitable sealing structure. Tapered fasteners 40 and 42, when tightened with respect to their respective positions in tapered recess 66, facilitate precise location and positioning of fixture 20 into final mounted position, as shown in FIG. 1. The interaction between tapered recess 66 and tapered fasteners 40 and 42 further facilitates control over the sealing compression between fixture 20 and box 30. When tapered fasteners 40 and 42 are tightened, fixture 20 is drawn into a fully sealed position. When vertical plates 44 and 46 are part of a one-piece bracket, horizontal water/air-tight sealing closure 59 is preferably mounted to a horizontal portion of the bracket. A second horizontal water/air-tight sealing closure 61 is preferably positioned between box 20 and the ceiling for sealing engagement of box 20 to the ceiling.

Figure 6:
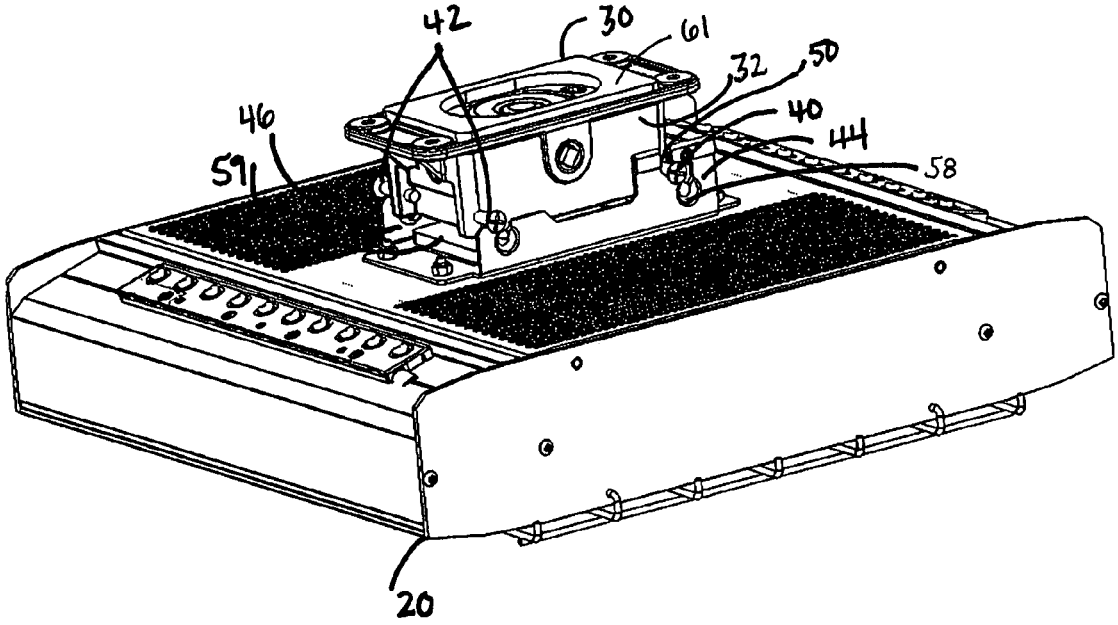
FIG. 6 is still another perspective view of the ceiling fixture mount-facilitating assembly of FIG. 6, showing the assembly wherein the first fastener is positioned in the entry slot.
Figure 7:
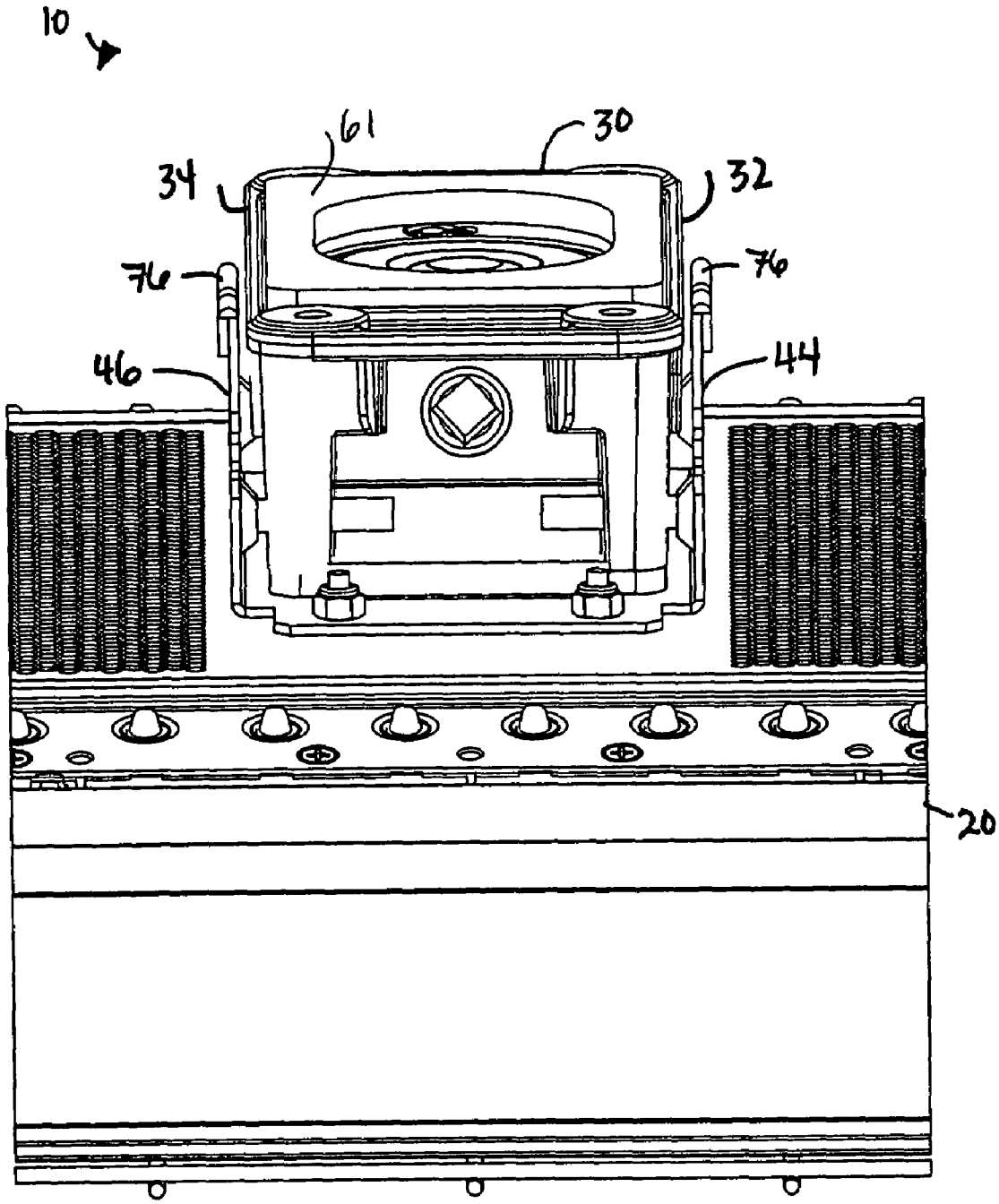
FIG. 7 is a top-end perspective view of a ceiling fixture mount-facilitating assembly in accordance with the invention.

As can be seen in FIG. 5, fixture 20 is mounted to ceiling fixture assembly 10 by fasteners. Though bolts are shown, any suitable type of fastener is acceptable. Ceiling fixture assembly 10 supports fixture 20 while the electrical connection is made. As shown in FIG. 5, fixture 20 is supported by ceiling fixture assembly 10 while assembly 10 is in an open and serviceable position. As seen in FIG. 6, after the wiring connections are completed, fixture 20 simply swings or slides upwardly, moving fasteners 40 from entry slot 68 and into position with respect to first mounting slots 58. This movement brings fixture 20 into final mounted position. Fasteners 40 and 42 are then tightened with respect to their positions in respective tapered recess 66.

While the principles of the invention have been shown and described in connection with specific embodiments, it is to be understood that such embodiments are by way of example and are not limiting.

The invention claimed is:

1. In a ceiling fixture mounting assembly including (1) a box for affixing to a ceiling and containing electrical wiring, the box having opposite vertical sidewalls each with first and second laterally spaced threaded holes receiving corresponding first and second fasteners, and (2) two vertical mounting plates each projecting upwardly from the fixture to terminate in an upper edge and positioned to overlie one of the sidewalls and each having first and second ways receiving the first and second fasteners, respectively, the first way configured for supporting the fixture at an angle to the box for connecting the wires, the improvement comprising:

each fastener having a head and a threaded portion; and the first and second ways having first and second mounting slots, respectively, each mounting slot having a lower closed end and an upper open end and sized smaller than the head, each plate having a recess at the closed end configured to receive the head such that it is in vertical alignment with the open end, thereby holding the plate in position against the box; and the first way of each plate further includes:

an entry slot extending from the upper edge downwardly and laterally to join the open end of the first mounting slot: and a hanging slot laterally offset from the entry slot and extending from an upper closed end to join the open end of the first mounting slot, the hanging slot loosely receiving the threaded portion of the first fastener, whereby the plates and fixture are suspended by the first fasteners at an angle to facilitate wiring and service of the fixture.

2. The ceiling fixture mounting assembly of claim 1 wherein the recess is tapered.

3. The ceiling fixture mounting assembly of claim 2 wherein the fastener head includes a taper toward the threaded portion of the fastener mating with the tapered recess.

4. The ceiling fixture mounting assembly of claim 1 wherein the plates are part of a one-piece bracket.

5. The ceiling fixture mounting assembly of claim 4 wherein the one-piece bracket further includes a horizontal water/air-tight sealing closure positioned between the box and the fixture for sealingly engaging the box when the fixture is in final mounted position.

6. The ceiling fixture mounting assembly of claim 5 wherein the recess is tapered.

7. The ceiling fixture mounting assembly of claim 6 wherein the fastener head includes a taper toward the threaded portion of the fastener mating with the tapered recess.

8. The ceiling fixture mounting assembly of claim 1 wherein the recess is tapered.

9. The ceiling fixture mounting assembly of claim 8 wherein the fastener head includes a taper toward the threaded portion of the fastener.

10. The ceiling fixture mounting assembly of claim 1 wherein the hanging slot is bounded by a downwardly extending retainer portion of the plate between the entry slot and the hanging slot, thereby restricting the fixture from lateral movement in its hanging position.

11. The ceiling fixture mounting assembly of claim 1 wherein the plates are part of a one-piece bracket.

12. The ceiling fixture mounting assembly of claim 11 wherein each upper edge includes a folded-over portion adjacent to and above the closed end of the hanging slot, thereby to strengthen the plate in that area.

13. The ceiling fixture mounting assembly of claim 11 wherein for each plate:

the open ends of the mounting slots are in substantial lateral alignment such that, after wiring and rotation of the hanging fixture to a horizontal orientation, movement of the fixture into final mounted position is with the fixture in substantially horizontal orientation; and the upper edge of each plate includes first and second edge-portions defining the first and second ways, respectively, the second edge-portion being lower than the first edge-portion to facilitate reception of the second fastener into the second mounting slot.

14. The ceiling fixture mounting assembly of claim 11 wherein the mounting slots are substantially vertical.

15. The ceiling fixture mounting assembly of claim 14 wherein the hanging slot and the first mounting slot are substantially vertically aligned, thereby to facilitate assumption of the angled hanging position upon loosening of the fasteners.

16. The ceiling fixture mounting assembly of claim 11 wherein the hanging slot and the first mounting slot are substantially aligned, thereby to facilitate assumption of the angled hanging position upon loosening of the fasteners.

17. The ceiling fixture mounting assembly of claim 16 wherein the recess is tapered.

18. The ceiling fixture mounting assembly of claim 17 wherein the fastener head includes a taper toward the threaded portion of the fastener.

19. In a ceiling fixture mounting assembly including (1) a box for affixing to a ceiling and containing electrical wiring, the box having opposite vertical sidewalls each with first and second laterally spaced threaded holes receiving corresponding first and second fasteners, and (2) two vertical mounting plates each projecting upwardly from the fixture to terminate in an upper edge and positioned to overlie one of the sidewalls and each having first and second ways adapted to receive the first and second fasteners, respectively, the improvement comprising:

each fastener having a head and a threaded portion;

each plate having first and second mounting slots, respectively, each mounting slot having a lower closed end and an upper open end and being sized smaller than the head, and each plate further having a tapered recess at the closed end configured to receive the head such that it is in vertical alignment with the open end, thereby holding the plate in position against the box;

the first way having:

an entry slot extending from the upper edge downwardly and laterally to join the open end of the first mounting slot; and a hanging slot laterally offset from the entry slot and extending from an upper closed end to join the open end of the first mounting slot, the hanging slot loosely receiving the threaded portion of the first fastener, and a horizontal water/air-tight sealing closure positioned between the box and the fixture thereby sealingly engaging the box when the fixture is in final mounted position.

20. The ceiling fixture mounting assembly of claim 19 wherein the fastener head includes a taper toward the threaded portion of the fastener mating with the tapered recess.

21. The ceiling fixture mounting assembly of claim 19 wherein the plates are part of a one-piece bracket.

22. The ceiling fixture mounting assembly of claim 21 wherein for each plate:

the open ends of the mounting slots are in substantial lateral alignment such that, after wiring and rotation of the hanging fixture to a horizontal orientation, movement of the fixture into final mounted position is with the fixture in substantially horizontal orientation; and the upper edge of each plate includes first and second edge-portions defining the first and second ways, respectively, the second edge-portion being lower than the first edge-portion to facilitate reception of the second fastener into the second mounting slot.

23. The ceiling fixture mounting assembly of claim 22 wherein the mounting slots are substantially vertical.

24. The ceiling fixture mounting assembly of claim 19 wherein the fastener head includes a taper toward the threaded portion of the fastener.

* * * * *